US006726199B2

(12) United States Patent
Ina et al.

(10) Patent No.: US 6,726,199 B2
(45) Date of Patent: Apr. 27, 2004

(54) SWITCHBACK DEVICE AND SWITCHBACK METHOD

(75) Inventors: Atsushi Ina, Kanagawa-ken (JP); Kunio Fukatsu, Kanagawa-ken (JP); Koji Kurokawa, Kanagawa-ken (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 72 days.

(21) Appl. No.: 10/233,111

(22) Filed: Sep. 3, 2002

(65) Prior Publication Data

US 2003/0057636 A1 Mar. 27, 2003

(30) Foreign Application Priority Data

Sep. 21, 2001 (JP) ..... P2001-290113

(51) Int. Cl.[7] ..... B65H 29/66; B65H 39/10; B65H 29/00

(52) U.S. Cl. ..... 271/65; 271/186; 271/291; 399/364

(58) Field of Search ..... 271/65, 186, 291; 399/364; B65H 29/66, 39/10, 29/00

(56) References Cited

U.S. PATENT DOCUMENTS 4,629,382 A 12/1986 Ueshin
5,887,868 A * 3/1999 Lambert et al. ..... 271/186
6,081,688 A * 6/2000 Okada et al. ..... 399/374
6,144,814 A * 11/2000 Newell et al. ..... 399/16
6,354,589 B1 * 3/2002 Taruki et al. ..... 271/265.01
6,419,222 B1 * 7/2002 Morrison et al. ..... 271/186
2001/0024012 A1 * 9/2001 Kato ..... 271/225

FOREIGN PATENT DOCUMENTS

JP 1-299163 * 12/1989 ..... B65H/43/00

* cited by examiner

*Primary Examiner*—Donald P. Walsh
*Assistant Examiner*—Kenneth W Bower
(74) *Attorney, Agent, or Firm*—Pillsbury Winthrop LLP

(57) ABSTRACT

The switchback device has two switchback portions for inverting the conveying path of paper-like materials and a detour conveying path. The switchback portions receive paper-like materials in the nip between the switchback rollers and the pinch rollers, clamp the paper-like materials, decelerate, stop, and accelerate them in the opposite direction in a clamping state, thereby switch back the paper-like materials. The stopping time of paper-like materials in the switchback portions is changed according to the length of the paper-like materials in the conveying direction.

11 Claims, 9 Drawing Sheets

SWITCHBACK DEVICE AND SWITCHBACK METHOD

CROSS-REFERENCE TO RELATED APPLICATIONS

This application is based upon and claims the benefit of priority from the prior Japanese Patent Application No. 2001-290113, filed on Sep. 21, 2001: the entire contents of which are incorporated herein by reference.

BACKGROUND OF THE INVENTION

The present invention relates to a switchback device and switchback method for inverting the conveying direction of a paper-like material and inverting the top and bottom of the paper-like material.

Conventionally, as a switchback device for inverting the conveying direction of a paper-like material and inverting the top and bottom of the paper-like material, a switchback device of a type of allowing the end of a paper-like material in the conveying direction to collide with a stopper, stopping the conveying of the paper-like material once, sending the paper-like material with the back end thereof positioned ahead in the opposite direction, thereby inverting the conveying direction of the paper-like material is known.

However, in a switchback device of this kind, a paper-like material is stopped by letting the end thereof collide with a stopper, so that a paper-like material comparatively unstiff is bent, thus a jam may occur.

Further, when a switchback device of this kind is applied to a device for continuously conveying a plurality of kinds of paper-like materials different in the length in the conveying direction in a coexisting state, even if the paper-like materials are sent to the switchback device at a constant conveying pitch, a problem arises that the conveying pitch of the paper-like materials after inversion of the top and bottom is not always constant.

Furthermore, when a plurality of paper-like materials continuously sent at a constant conveying pitch are to be continuously switched back, if the conveying pitch between two paper-like materials to be continuously sent is lower than the reference value, a problem arises that the preceding paper-like material collides with the succeeding paper-like material in the switchback device and a paper jam occurs.

BRIEF SUMMARY OF THE INVENTION

The present invention is intended to provide a switchback device and switchback method for inverting paper-like materials stably and surely and keeping the conveying pitch between paper-like materials after inversion constant.

According to the present invention, a switchback device is provided and the device comprises a conveying path to continuously convey a plurality of paper-like materials; a switchback portion to receive the paper-like material conveyed on the conveying path in a nip, clamping the paper-like material, decelerate and stop the paper-like material in the clamping state, then accelerate in an opposite direction, send onto the conveying path, thereby invert a conveying direction of the paper-like material; and a controller to keep the paper-like material stopped in the switchback portion for a time decided depending on a length of the paper-like material to be conveyed to the switchback portion in the conveying direction and control an inversion operation for the paper-like material by the switchback portion so as to send out all paper-like materials from the switchback portion at a same conveying pitch as that before inversion.

Further, according to the present invention, a switchback method is provided and the method comprises continuously conveying a plurality of paper-like materials along a conveying path; receiving the paper-like material conveyed on the conveying path in a nip; clamping the paper-like material in the nip; decelerating and stopping the paper-like material in the clamping state; accelerating the paper-like material in an opposite direction; sending the paper-like material onto the conveying path, thereby invert a conveying direction of the paper-like material; keeping the paper-like material stopped for a time decided depending on a length of the paper-like material to be conveyed in the conveying direction; and controlling an inversion operation for the paper-like material so as to send out all paper-like materials at a same conveying pitch as that before inversion.

DETAILED DESCRIPTION OF THE INVENTION

The embodiment of the present invention will be explained in detail hereunder with reference to the accompanying drawings.

Figure 1:
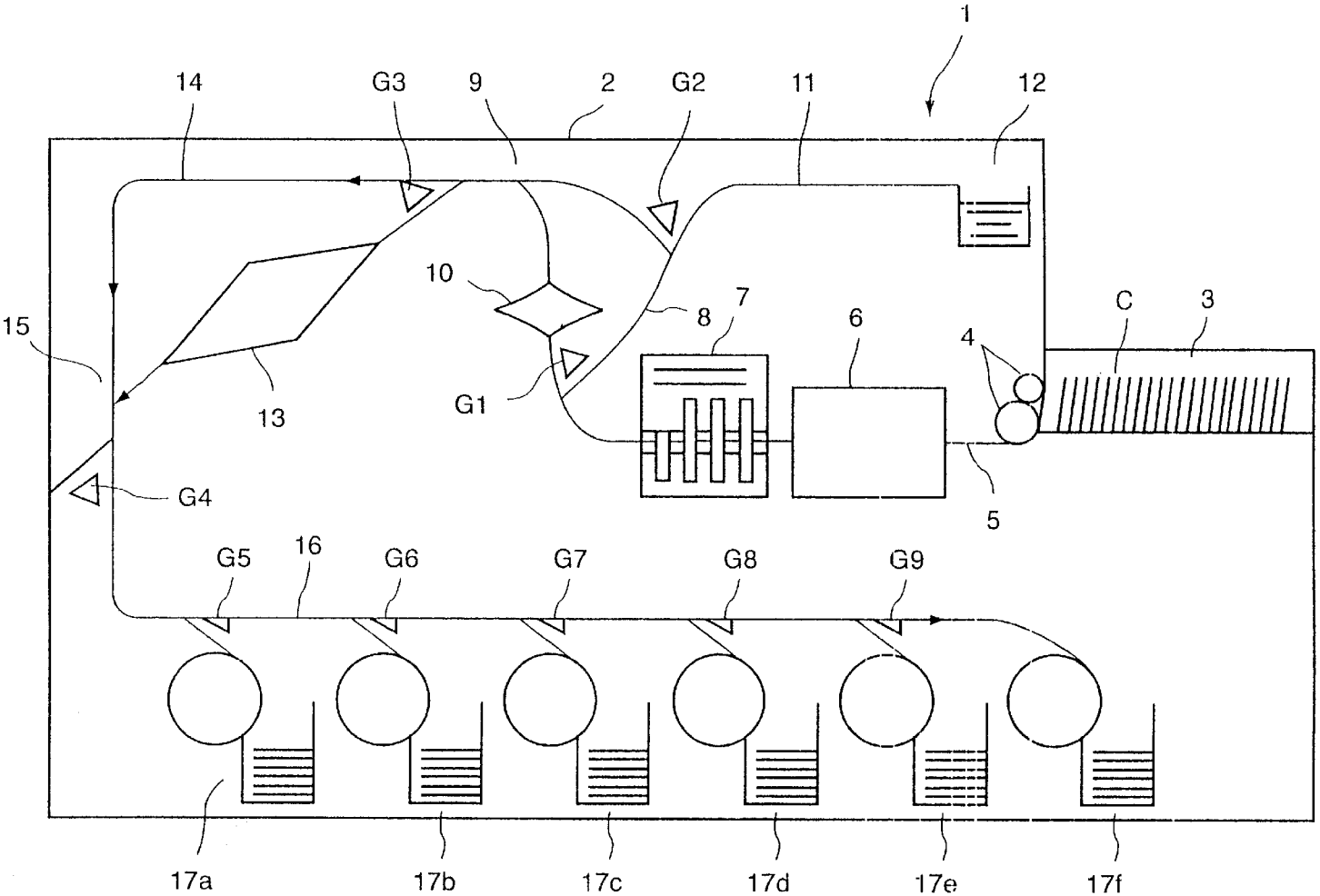
FIG. 1 is a schematic view showing a paper-like material processing apparatus relating to the embodiment of the present invention.

FIG. 1 schematically shows the structure of a paper-like material processing apparatus 1 relating to the embodiment of the present invention. The paper-like material processing apparatus 1 inserts a plurality of kinds of paper-like materials different in size in a coexisting state into an insert port in a batch, arranges the "front and back" and "top and bottom" of all paper-like materials respectively in the same direction, and classifies and stacks them for each kind.

The paper-like material processing apparatus 1 has a housing 2 in an almost rectangular box shape which is an outer shell thereof. In the stepped part on the upper right of the drawing of the housing 2, an insert port 3 where a plurality of paper-like materials C are inserted in a batch in a state that they are stacked in the surface direction and set in an upright state in the transverse direction thereof is installed. The insert port 3 arranges all paper-like materials C by making the lower end sides in the longitudinal direction contact with the stage. In addition to this arrangement, the insert port 3 moves a backup plate not shown in the drawing along the stage in the surface direction of the paper-like materials C and presses the paper-like material C at the left end of the drawing on the stage against a pair of take-out rollers 4. When the pair of rollers 4 rotate, the paper-like materials C on the stage are sequentially taken out starting from the one at the left end from the lower end side thereof onto a conveying path 5.

On the conveying path 5 in the neighborhood of the insert port 3, a posture correction device 6 is installed. The posture correction device 6 corrects a defective posture of a paper-like material C in each processing portion installed on the conveying path 5 on the downstream side of the posture correction device 6. Namely, to prevent a defect due to a skew or a shift, the posture correction device 6 corrects a skew and a shift of each paper-like material C. In this embodiment, the posture correction device 6 corrects the conveying posture of each paper-like material C so that the center of the paper-like material C taken out in the transverse direction is positioned on the central line of the conveying path 5 and the longer end side of the paper-like material C in the longitudinal direction is orthogonal to the central line.

On the conveying path 5 in the neighborhood of the posture correction device 6, a detecting device 7 for detecting characteristics such as the kind of each paper-like material C, size, directions of the "front and back" and "top and bottom", and existence of soil or damage is installed. The detecting device 7 reads various types of information from the surface of each paper-like material C conveyed on the conveying path 5, carries out logic operations for the read information and compares it with the standard information, and detects the aforementioned characteristics of each paper-like material C.

On the conveying path 5 on the downstream side of the detecting device 7, a plurality of gates G1 to G9 for selectively switching the conveying direction of each paper-like material C on the basis of the detection results of the detecting device 7 are installed.

On one conveying path branched at the position of the gate G1 installed on the uppermost stream side, a switchback device 10 relating to the embodiment of the present invention is installed. The switchback device 10 functions so as to invert the conveying direction of each paper-like material C conveyed via the gate G1, invert the top and bottom, and send it onto the conveying path again.

The other conveying path branched at the position of the gate G1 functions as a detour conveying path 8 for detouring the switchback device 10. The detour conveying path 8 is preset in such a length that a paper-like material C passing the switchback device 10 via the gate G1 and a paper-like material C passing the detour conveying path 8 reach a joining portion 9 at the same time interval.

The detour conveying path 8 is branched to a rejection root path 11 on the way to the joining portion 9 and the gate 2 is installed at this branch position. At the terminal of the rejection root path 11 branched via the gate G2, a rejection box 12 for receiving a paper-like material C to be rejected is installed. The paper-like material C to be rejected is a paper-like material decided as the process at the latter stage being impossible such as paper-like materials which are decided as double feed by the detecting device 7, a paper-like material decided as greatly skewed beyond a predetermined level, or a paper-like material severely damaged. Further, a paper-like material whose characteristics cannot be detected by the detecting device 7 is also received into the rejecting box 12. The rejecting box 12 is arranged above the insert port 3 and can be accessed from outside the housing 2.

The conveying path 5 on the downstream side of the joining portion 9 is branched in two directions again and the gate G3 is installed at the position of the branch. On one conveying path branched at the position of the gate G3, a front/back reversing mechanism 13 as indicated in U.S. Pat. No. 4,629,382 (Dec. 16, 1986) is installed. The front/back reversing mechanism 13 has a twist conveying path twisted at 180° round the central axis from the inlet thereof to the outlet. And, when a paper-like material C passes the twist conveying path, the front and back of the paper-like material C is inverted.

The other conveying path branched at the position of the gate G3 functions as a detour conveying path 14 for detouring the front/back reversing mechanism 13. The detour conveying path 14 is preset in such a length that a paper-like material C passing the front/back reversing mechanism 13 via the gate G3 and a paper-like material C passing the detour conveying path 14 reach a joining portion 15 at the same time interval.

One conveying path branched in two directions at the position of the gate G4 on the downstream side of the joining portion 15 functions as a horizontal conveying path 16 extending almost horizontally in the right direction of the drawing. On the horizontal conveying path 16, the remaining five gates G5 to G9 are installed at almost equal intervals. At the positions branched respectively by the gates G5, G6, G7, G8, and G9 below the horizontal conveying path 16, six stackers 17*a* to 17*f* larger than the number of gates by one are installed.

The paper-like materials C passing the joining portion 15 selectively pass the switchback device 10 and/or the front/back reversing mechanism 13 and the directions of the "front and back" and "top and bottom" are arranged in a fixed direction respectively. Therefore, paper-like materials C stacked in the respective stackers 17*a* to 17*f* are arranged in the "front and back" and "top and bottom" and respectively stacked in predetermined stackers for each kind.

Further, the other conveying path branched at the position of the gate G4 is derived outside the housing 2 of the processing apparatus 1 and connected to an external device not shown in the drawing.

Next, the switchback device 10 will be explained in detail by referring to FIG. 2.

The switchback device 10 has a gate 21 for selectively pointing paper-like materials C conveyed via the gate G1 to two switchback portions 20R and 20L (first and second switchback portions) installed symmetrically right and left with respect to the conveying path 5. Namely, the paper-like materials C conveyed to the switchback device 10 are alternately sent to the left and right switchback portions 20R and 20L by switching the gate 21 between the two positions. Further, the two switchback portions 20R and 20L have almost the same structure and function, so that here the switchback portion 20R installed on the right of the conveying path 5 will be explained representatively. Therefore, with respect to the switchback portion 20L on the left, the same numerals (L is added at the end of each numeral) are respectively assigned to the members functioning in the same way and detailed explanation will be omitted.

The switchback portion 20R has a tapping wheel 22R for guiding the end of a paper-like material C conveyed via the gate 21 in the conveying direction into the switchback portion 20R, two switchback rollers 23R installed in parallel on one side of the paper-like material C guided via the tapping wheel 22R, two pinch rollers 24R pressed against each roller 23R so as to clamp the paper-like material C between the switchback rollers 23R and themselves, and a motor 25R for rotating the two switchback rollers 23R in the forward and backward directions. Further, on the conveying path of paper-like materials C passing the switchback portion 20R, a plurality of guide members for guiding the paper-like materials C are installed.

Figure 3:
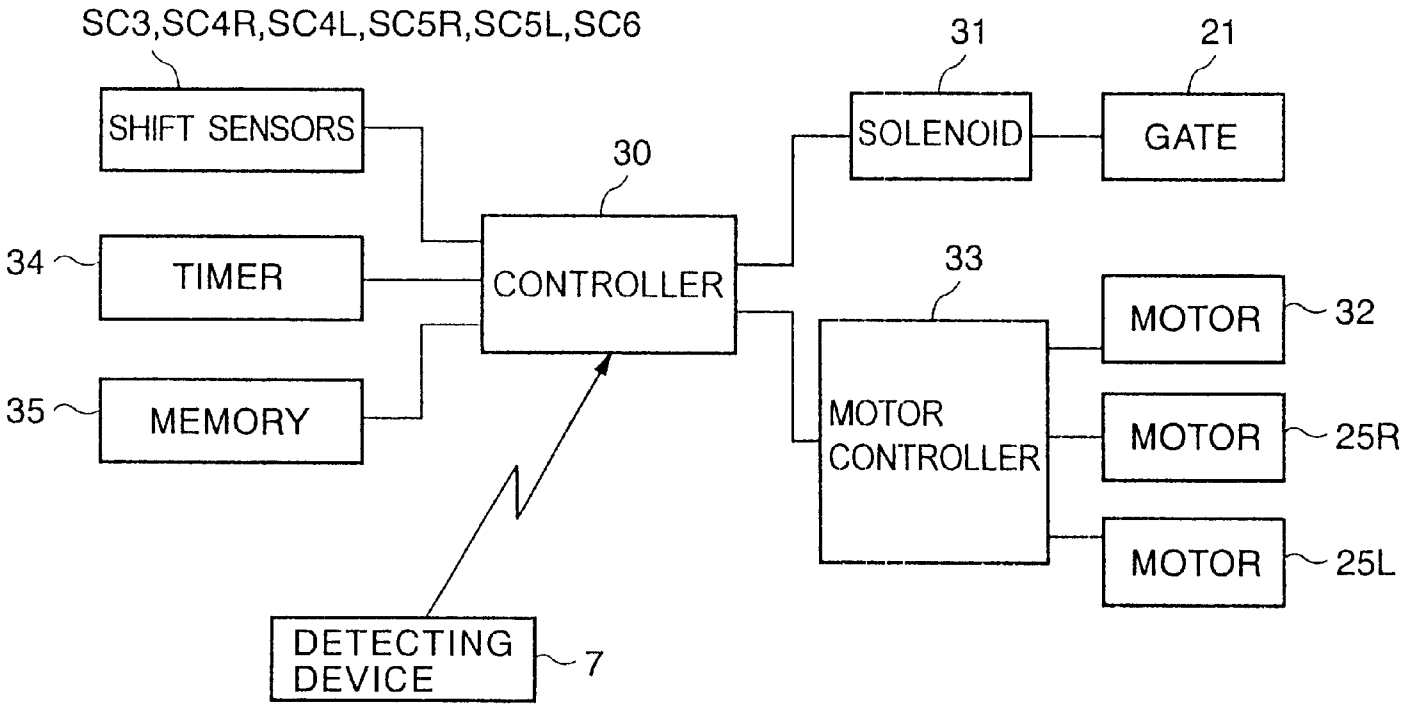
FIG. 3 is a block diagram showing the control system for controlling the operation by the switchback device shown in FIG. 2.

FIG. 3 shows a block diagram of the control system for controlling the operation of the switchback device 10. To the controller 30 for controlling the operation of the switchback device 10, a solenoid 31 for driving six shift sensors SC3, SC4R, SC4L, SC5R, SC5L, and SC6 for monitoring paper-like materials passing the switchback device 10 and the gate 21, a motor 32 for rotating the tapping wheels 22R and 22L installed respectively in the left and right switchback portions 20R and 20L, a motor controller 33 for driving the motors 25R and 25L for rotating the switchback rollers 23R and 23L in the forward and backward directions, a timer 34 for measuring the passing time of paper-like materials C through the shift sensors SC3 and SC6 so as to detect the conveying pitch thereof and measuring the stopping time thereof in the switchback portions 20R and 20L, and a memory 35 storing the operation program of the switchback device 10, the aforementioned stopping time according to the length of each paper-like material C in the conveying direction, and the deceleration time, acceleration time, and stopping time of paper-like materials C according to the aforementioned measured conveying pitch beforehand are connected.

Figure 2:
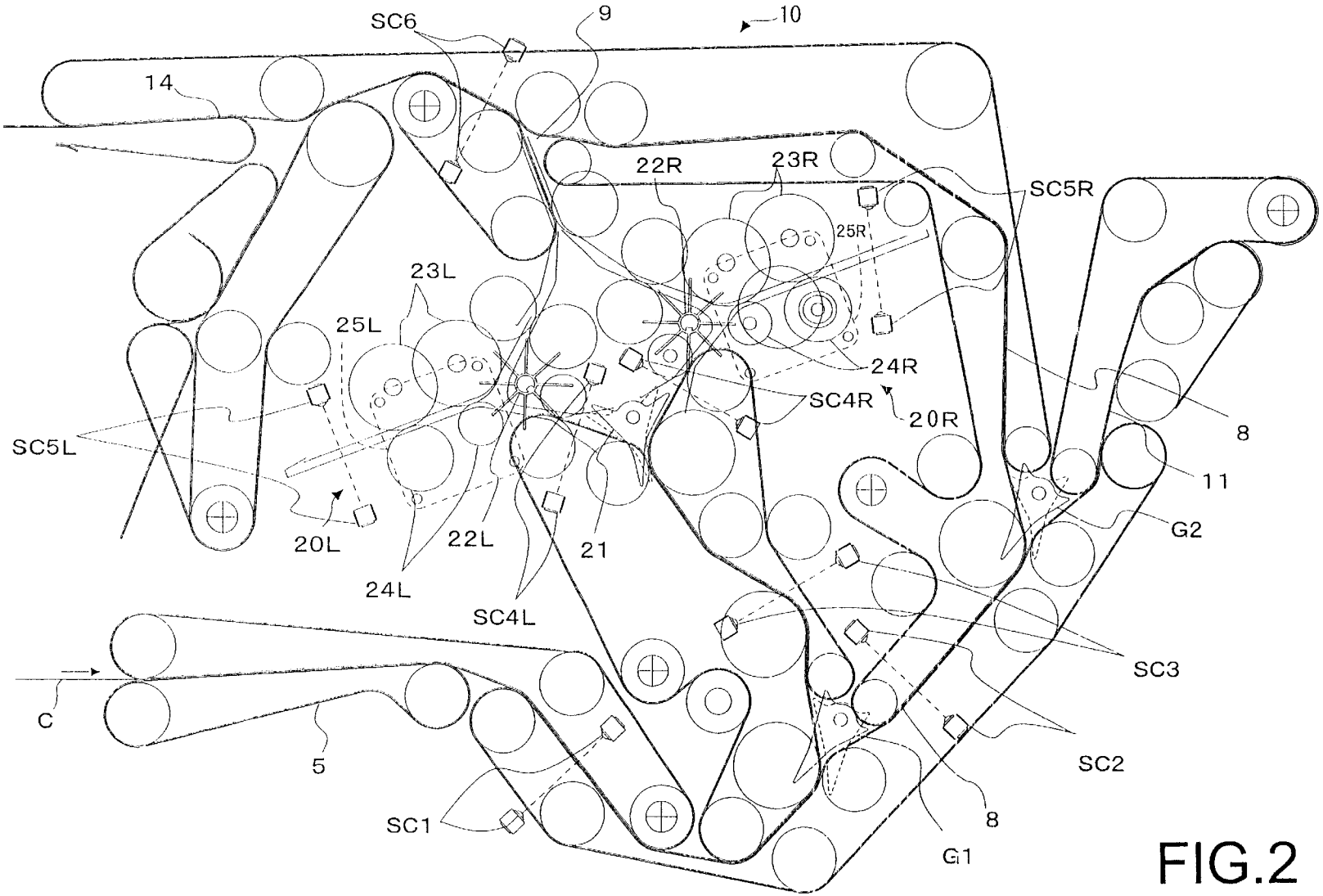
FIG. 2 is a schematic view showing the structure of the switchback device incorporated in the apparatus shown in FIG. 1.

As shown in FIG. 2, the shift sensor SC1 is installed on the conveying path 5 on the upstream side of the gate G1 in the conveying direction. The shift sensor SC2 is installed on the detour conveying path 8 immediately behind the gate G1. The shift sensor SC3 is installed on the conveying path 5 reaching the gate 21 from the gate G1. The shift sensor SC4R is installed at the position for detecting paper-like materials moving from the gate 21 to the switchback portion 20R on the right. The shift sensor SC5R is installed at the position for detecting paper-like materials guided to the switchback portion 20R on the right. The shift sensor SC6 is installed on the conveying path 5 immediately behind the joining portion 9. The shift sensor SC3 functions as an upstream pitch sensor of the present invention, and the shift sensor SC4R functions as a timing sensor of the present invention, and the shift sensor SC6 functions as a downstream side pitch sensor of the present invention.

Next, the processing operation by the switchback device 10 structured as mentioned above will be explained by referring to FIGS. 2 to 10.

Firstly, as shown in FIG. 2, in timing with passing of a paper-like material C conveyed via the conveying path 5 from the left of the drawing through the shift sensor SC1, the gate G1 is switched. The gate G1, when the paper-like material C is a paper-like material to be switched back, is switched to the position shown by a dashed line in FIG. 2 so as to guide the paper-like material C to the switchback device 10 and when it is judged that the paper-like material C is a paper-like material not to be switched back or the paper-like material C is a paper-like material which cannot be reused, the gate G1 is switched to the position (shown by a solid line in FIG. 2) for guiding the paper-like material C to the detour conveying path 8.

And, the gate G2 is switched in timing with passing of the paper-like material C guided to the detour conveying path 8 via the gate G1 through the shift sensor SC2. The gate G2, when the paper-like material C is a paper-like material which cannot be reused, is switched to the position (shown by a solid line in FIG. 2) for guiding the paper-like material C to the rejection root path 11 and when the paper-like material C is a paper-like material other than it, the gate G2 is switched to the position (shown by a dashed line in FIG. 2) for guiding the paper-like material C to the joining portion 9.

Further, in timing with passing of the end of the paper-like material C guided to the switchback device 10 via the gate G1 in the conveying direction through the shift sensor SC3, the gate 21 is switched. The gate 21 is switched so as to distribute the paper-like material C led to the switchback device 10 alternately to the left and right switchback portions 20R and 20L.

Figure 4:
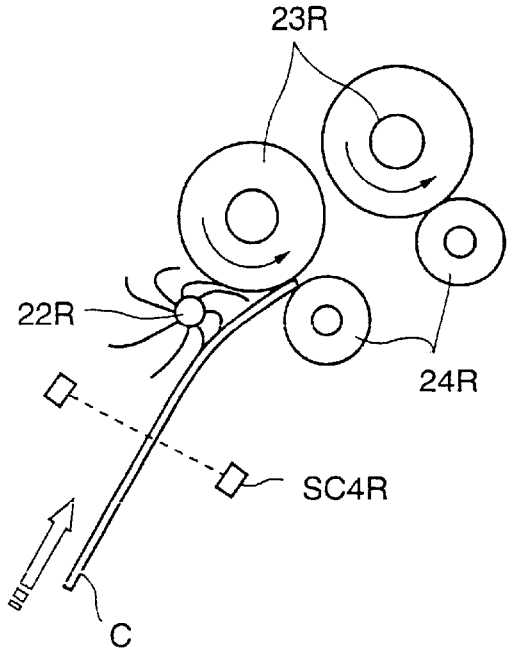
FIG. 4 is an operation illustration for illustrating the operation by the switchback device shown in FIG. 2.

For example, when the gate 21 is switched to the position shown by a solid line in FIG. 2, the paper-like material C is led to the switchback portion 20R on the right. The paper-like material C guided to the switchback portion 20R, as shown in FIG. 4, is detected passing of the end thereof in the conveying direction by the shift sensor SC4R, then guided by the tapping wheel 22R, and led to the nip between the paired rollers 23R and 24R. The paper-like material C received in the nip is clamped by the two nips between the two switchback rollers 23R and the two pinch rollers 24R and received in the switchback portion 20R in this state by the switchback rollers 23R rotating in the direction of the arrow (the forward direction) shown in the drawing.

Figure 5:
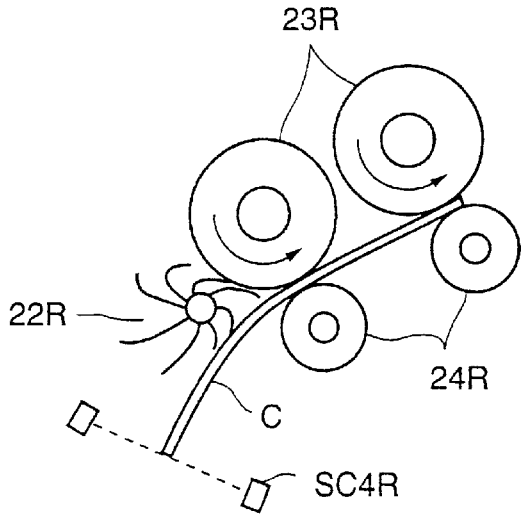
FIG. 5 is an operation illustration for illustrating the operation by the switchback device shown in FIG. 2.
Figure 6:
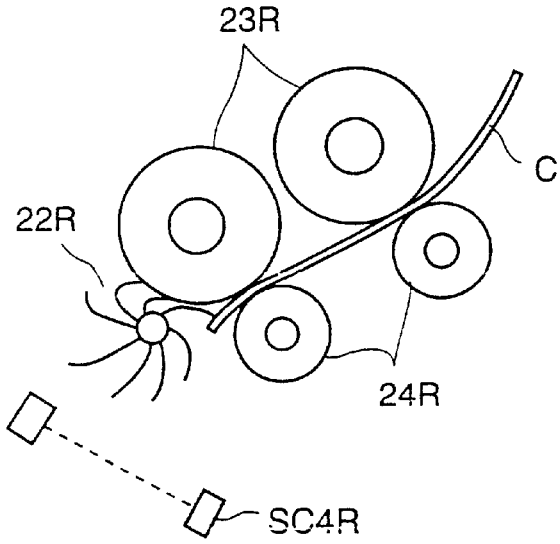
FIG. 6 is an operation illustration for explaining the operation by the switchback device shown in FIG. 2.
Figure 7:
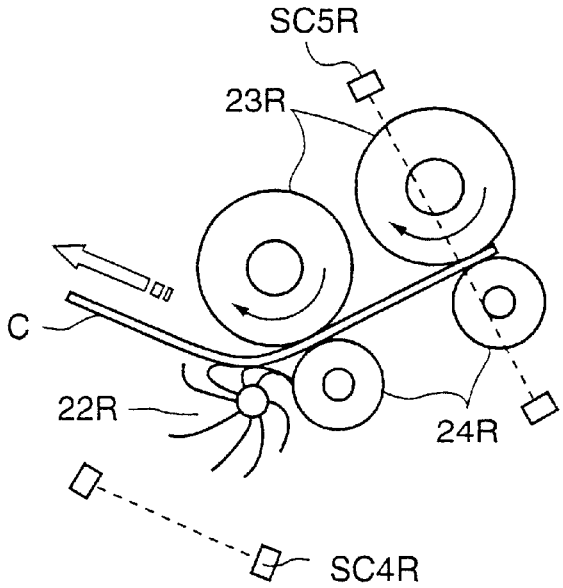
FIG. 7 is an operation illustration for illustrating the operation by the switchback device shown in FIG. 2.

And, as shown in FIG. 5, taking the detection of the back end of the paper-like material C in the conveying direction by the shift sensor SC4R as a trigger, the inversion operation for the paper-like material C is started by the switchback rollers 23R. By this inversion operation, the two switchback rollers 23R are sequentially decelerated and stopped (the state shown in FIG. 6) and inverted as shown in FIG. 7 after a lapse of a predetermined stopping time and the paper-like material C is accelerated in the opposite direction and sent from the switchback portion 20R. At this time, the end of the paper-like material C, inverted in the conveying direction, in the conveying direction is guided by the tapping wheel 22R as shown in FIG. 7 and the paper-like material C is led onto the conveying path via the joining portion 9.

Figure 8:
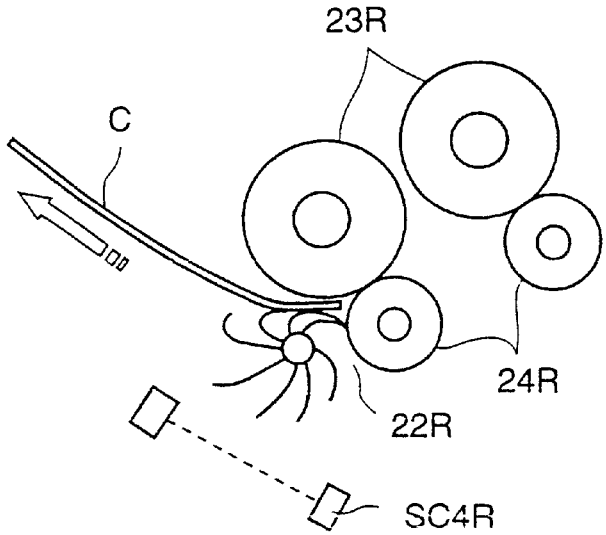
FIG. 8 is an operation illustration for illustrating the operation by the switchback device shown in FIG. 2.
Figure 9:
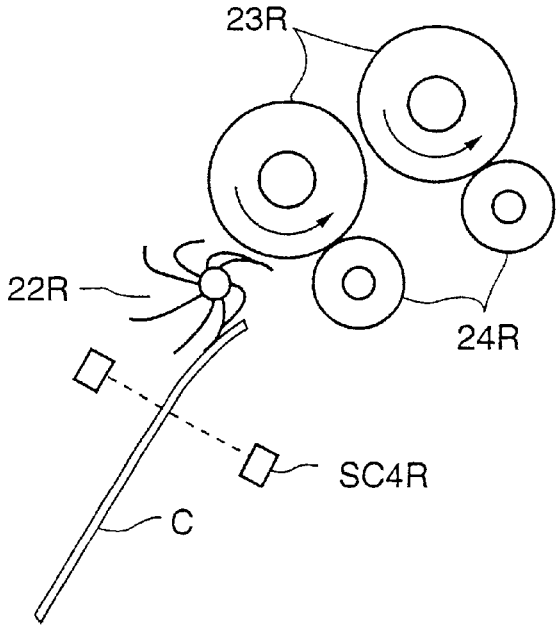
FIG. 9 is an operation illustration for illustrating the operation by the switchback device shown in FIG. 2.

At this time, taking the detection of the back end of the inverted paper-like material C in the conveying direction by the shift sensor SC5R installed in the switchback portion 20R as a trigger, the inverted switchback rollers 23R are decelerated and stopped. This state is shown in FIG. 8. And, after the paper-like material C after switching back is sent from the switchback portion 20R, as shown in FIG. 9, the switchback rollers 23R are accelerated in the forward direction and set up for receiving the next paper-like material C.

In this embodiment, during the inversion operation, the stopping time of the paper-like material C in the switchback portion 20R is changed depending on the length of the paper-like material C in the conveying direction. The length of the paper-like material C in the conveying direction is detected by the detecting device 7 beforehand or the time required for the paper-like material C to pass the plurality of shift sensors SC1, SC3, and SC4R installed on the conveying path extending to the switchback portion 20R is calculated.

Namely, the stopping time of the paper-like material C in the switchback portion 20R is preset according to the length of the paper-like material C so that the time required for detecting the end of the paper-like material C in the conveying direction by the shift sensor SC4R, switching back the paper-like material by the inversion operation, and then sending it from the switchback portion 20R, for example, the time required for the end of the paper-like material C in the conveying direction to reach the shift sensor SC6 is made equal for all paper-like materials C sent to the switchback device 10. In short, a comparatively short paper-like material is stopped for a comparatively long time and a comparatively long paper-like material is stopped for a comparatively short time. The stopping time preset according to the length of paper-like materials is stored in the memory 35 beforehand.

Namely, the controller 30 of the switchback device 10 obtains information concerning the length of the paper-like material C from the detecting device 7, reads the stopping time according to the length from the memory 35, and controls the inversion operation by the switchback rollers 23R so as to keep the paper-like material C stopped in the switchback portion 20R for this stopping time.

Figure 10:
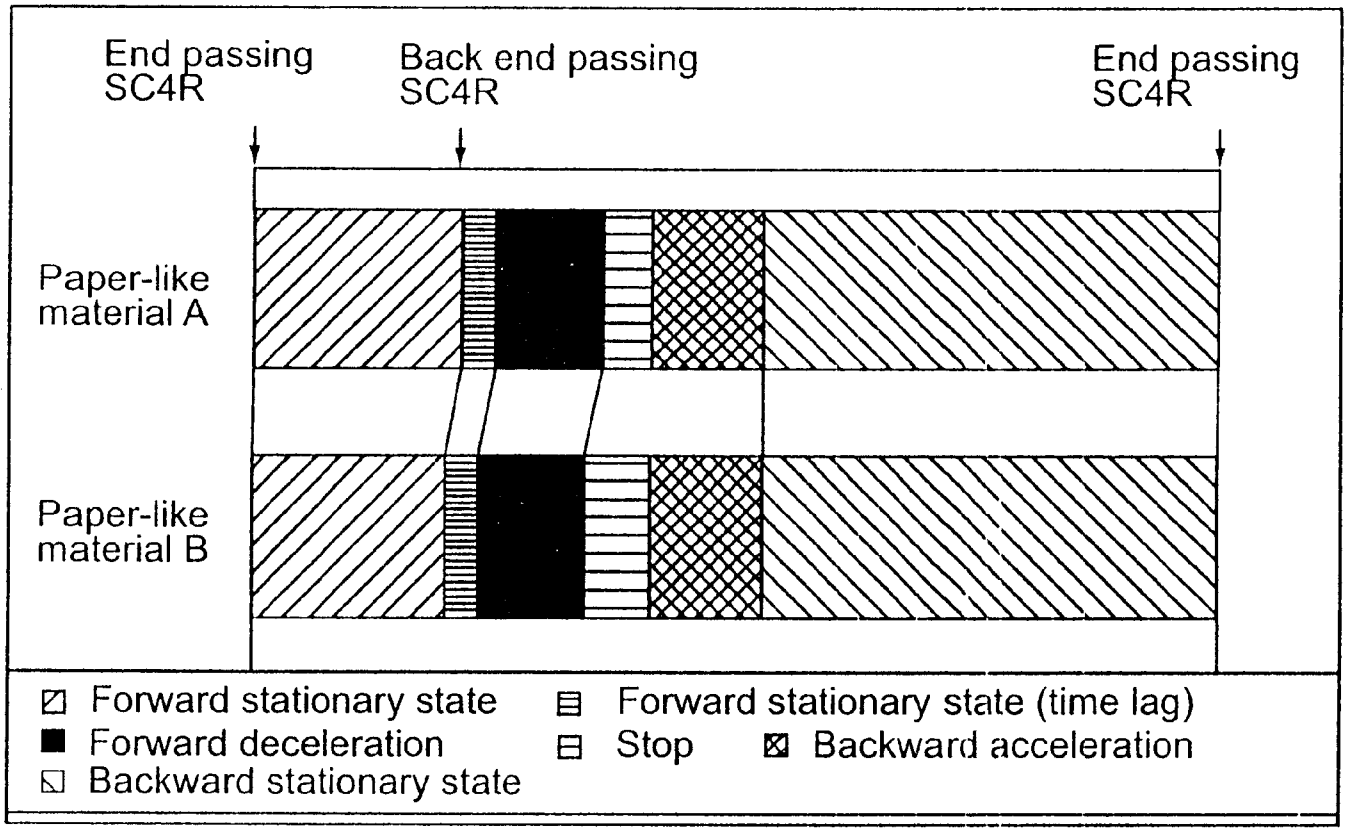
FIG. 10 is a time chart for showing the processing time of the inversion operation for paper-like materials different in length.

For example, as shown in FIG. 10, when the aforementioned stop control of the present invention is applied to two paper-like materials A and B different in length, the times required for the ends of the paper-like materials A and B to pass from the shift sensor SC4R to the shift sensor SC6 are the same.

Namely, with respect to the comparatively long paper-like material A, the time required for the shift sensor SC4R to detect from passing of the end thereof to passing of the back end thereof is comparatively long. On the other hand, the time required for the comparatively short paper-like material B to pass the shift sensor SC4R is comparatively short. Namely, the paper-like material B is earlier in the timing of starting the inversion operation than the paper-like material A. And, in a state of such a time difference, taking the passing of the back ends of the paper-like materials C through the shift sensor S4R as a trigger, the aforementioned inversion operation is started. In the inversion operation, by the switchback rollers 23R rotating in the forward direction after a predetermined time lag, the paper-like materials A and B are decelerated. The time lag and deceleration time are the same in the paper-like materials A and B. Here, the stopping time of the paper-like material A is made shorter than the stopping time of the paper-like material B by the aforementioned time difference. The stopping time, as mentioned above, is preset according to the length of the paper-like material and controlled by the controller 30. By doing this, the aforementioned time difference is offset. In a state that the time difference is offset in this way, the switchback rollers 23R are inverted and accelerated for the same time and the paper-like materials A and B are sent from the switchback portion 20R in the same timing.

When the processing time from sending of the paper-like material C to the switchback portion 20R to sending out from the switchback portion 20R, as mentioned above, is made equal for all paper-like materials C instead of deciding according to the length of the paper-like materials C, the conveying pitch of a plurality of paper-like materials C to be continuously sent to the switchback portion 20R can be made equal before and after switching back and the sending timing can be adjusted.

Next, the processing operation when a short pitch is caused in paper-like materials C to be sent to the switchback device 10 will be explained by referring to the flow chart shown in FIG. 11. Short pitch is referred to as a state that the conveying pitch P between two paper-like materials to be continuously conveyed is shorter than a preset reference pitch PO and it is highly probable that the two paper-like materials having a short pitch collide with each other in the switchback portion and cause a jam.

Figure 11:
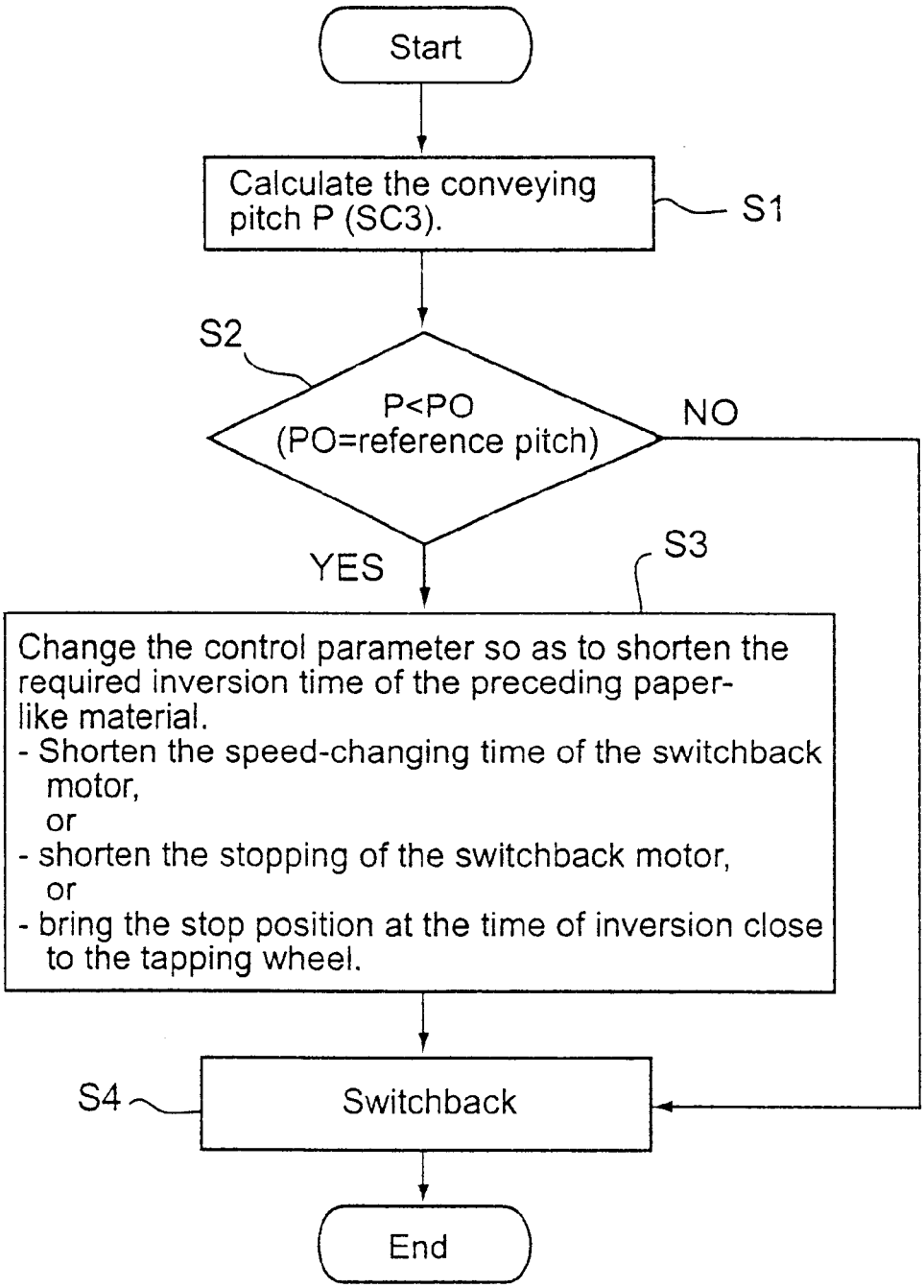
FIG. 11 is a flow chart for explaining the processing operation when a short pitch is generated.

As shown in FIG. 11, firstly, among two paper-like materials C continuously sent to the switchback device 10 via the gate G1, the back end of the preceding paper-like material C1 in the conveying direction and the end of the succeeding paper-like material C2 in the conveying direction are detected via the shift sensor SC3. And, by the controller 30, the conveying pitch P between the two paper-like materials is calculated from the difference between the passing times and the conveying speed (Step S1).

And, the conveying pitch P is compared with the preset reference pitch PO (Step S2). As a comparison result, when it is judged that the conveying pitch P is equal to or higher than the reference pitch PO (Step S2, NO), the two paper-like materials C1 and C2 are switched back as usual (Step 4).

On the other hand, as a result of judgment at Step S2, when it is judged that the conveying pitch P is lower than the reference pitch PO (Step S2, YES), the control parameter for the preceding paper-like material C1 is changed so as to shorten the processing time required for the inversion operation for the paper-like material C1 (Step S3). The control parameter is changed, for example, so as to shorten the acceleration time, deceleration time, and/or the stopping time of the motor 25R for rotating the switchback rollers 23R. Or, the control parameter is changed so as to shorten the conveying distance during the inversion operation of the paper-like material C1, concretely, to bring the stop position of the paper-like material C1 close to the tapping wheel 22R.

As mentioned above, a short pitch is detected on the conveying path on the upstream side of the switchback device 10, and among paper-like materials having a short pitch, the control parameter for the preceding paper-like material C1 is changed, and the preceding paper-like material C is earlier sent from the switchback portion, thus even paper-like materials in a short pitch state can be continuously switched back surely and stably.

Meanwhile, in the aforementioned embodiment, the length of the detour conveying path 8 for detouring the switchback device 10 is set so that paper-like materials C passing the switchback device 10 and paper-like materials C passing the detour conveying path 8 reach the joining portion 9 at the same time interval, so that regardless of existing of switching back, all paper-like materials C can reach the joining portion 9 in the same sequence and at the same pitch. However, the time required for paper-like materials C to pass the switchback device 10 and the time required to pass the detour conveying path 8 may be changed with time even if the conveying path lengths are made equal.

For example, in the switchback device 10, it is known that due to friction and soil with time between the switchback rollers 23R and 23L and the pinch rollers 24R and 24L, the clamping force for paper-like materials C is weakened with time. When the clamping force becomes weaker, the conveying speed for paper-like materials C is reduced and the time required to pass the switchback device 10 becomes longer.

Further, when the driving force for letting paper-like materials C pass the detour conveying path 8 is supplied to units other than the switchback device 10 in common, if the driving force becomes weaker due to load changes in the whole paper-like material processing apparatus 1, the conveying speed for paper-like materials passing the detour conveying path 8 is reduced and the passing time through the detour conveying path 8 becomes longer.

Figure 12:
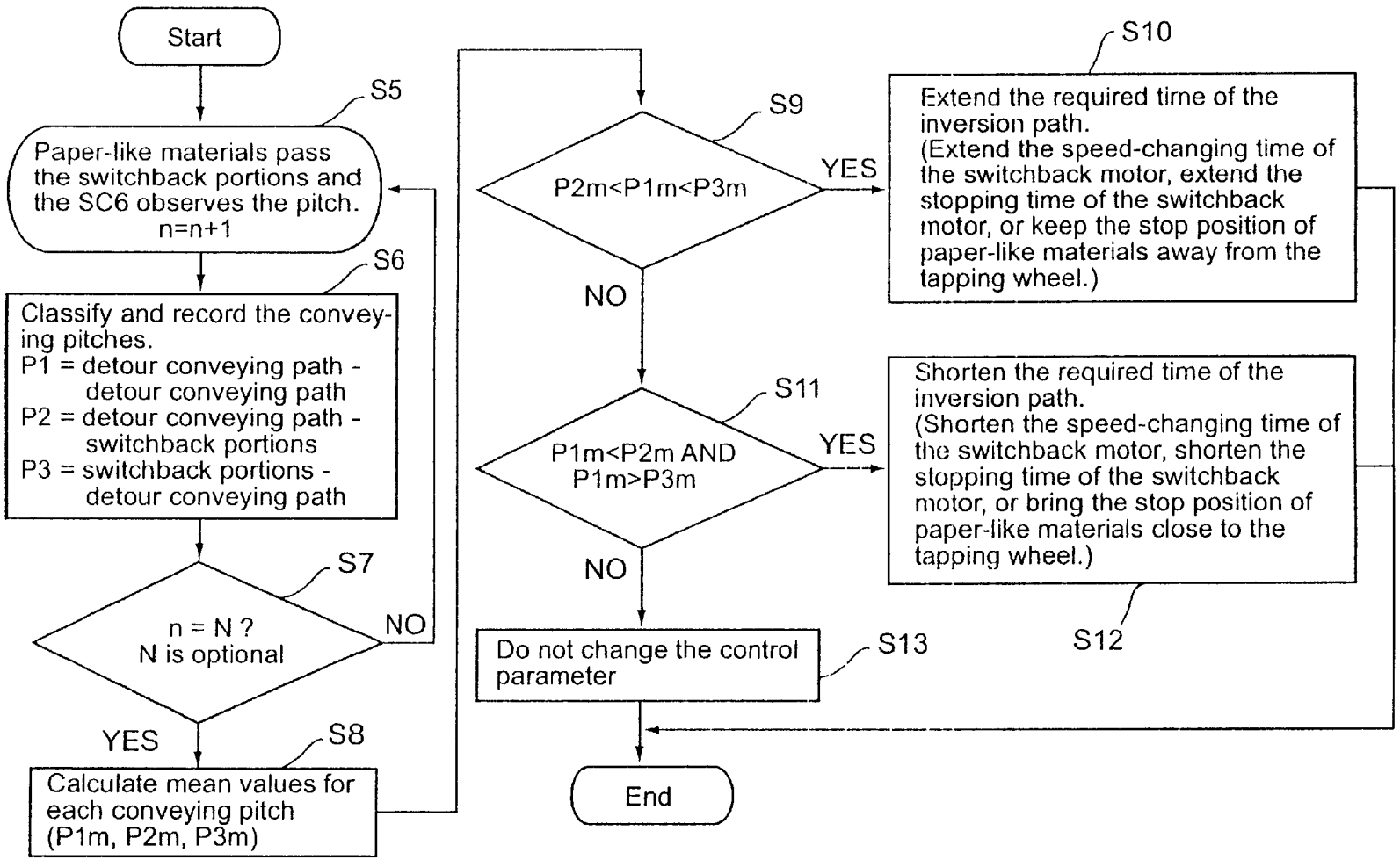
FIG. 12 is a flow chart for explaining the operation for monitoring the conveying pitch after switching back and changing the control parameter.

When the time required for paper-like materials C to pass the switchback device 10 and the time required for paper-like materials C to pass the detour conveying path 8 are changed with time like this, even if the switchback device is operated as mentioned above, the conveying pitch between paper-like materials C passing the joining portion 9 is not fixed. Therefore, in this embodiment, the conveying pitch of paper-like materials C passing the joining portion 9 is monitored by the shift sensor SC6, and the time difference between the time required to pass the switchback device 10 and the time required to pass the detour conveying path 8 is detected, and the control parameter of the switchback device 10 is periodically changed so as to eliminate the time difference Next, by referring to the flow chart shown in FIG. 12, the changing method for the control parameter for offsetting the change of the passing time with time will be explained.

Firstly, the conveying pitch of a plurality of paper-like materials C passing the switchback device or the detour conveying path 8 is continuously detected for a preset optional number of paper-like materials via the shift sensor SC6 (Step S5). Detection results are classified for each path of continuous two paper-like materials C and stored in the memory 35 (Step S6).

Concretely, the conveying pitch of a combination of, among continuous two paper-like materials C, passing of the preceding paper-like material C1 through the detour conveying path 8 and passing of the succeeding paper-like material C2 also through the detour conveying path 8 is assumed as P1, and the conveying pitch of a combination of passing of the preceding paper-like material C1 through the detour conveying path 8 and passing of the succeeding paper-like material C2 through the switchback device 10 is assumed as P2, and the conveying pitch of a combination of passing of the preceding paper-like material C1 through the switchback device 10 and passing of the succeeding paper-like material C2 through the detour conveying path 8 is assumed as P3.

And, mean values P1*m*, P2*m*, and P3*m* of P1, P2, and P3 which are classified and recorded in the memory 35 under the condition that the detection count of conveying pitches reaches the preset number N (Step S7, YES) are calculated (Step S8). Thereafter, these mean values P1*m*, P2*m*, and P3*m* are compared and the control parameter of the switchback device 10 is changed.

For example, when the relation of P2*m*<P1*m*<P3*m* is held (Step S9, YES), it can be judged that the time required for the paper-like materials C to pass the switchback device 10 is shorter than the time required for the paper-like materials C to pass the detour conveying path 8. In this case, the control parameter is changed so that the passing time through the switchback device 10 is made longer (Step S10). Concretely, the control parameter of the switchback device 10 is changed so as to make the acceleration time, deceleration time, and/or stopping time of the motor 25R for rotating the switchback rollers 23R longer. Or, so as to make the conveying distance during the inversion operation of paper-like materials C longer, that is, so as to keep the stop position of paper-like materials C away from the tapping wheel 22, the control parameter is changed.

When the relation of P1*m*<P2*m* is held and the relation of P1*m*>P3*m* is held (Step S11, YES), it can be judged that the time required for the paper-like materials C to pass the switchback device 10 is longer than the time required for the paper-like materials C to pass the detour conveying path 8. In this case, the control parameter is changed so that the passing time through the switchback device 10 is made shorter (Step S12). Concretely, the control parameter of the switchback device 10 is changed so as to make the acceleration time, deceleration time, and/or stopping time of the motor 25R for rotating the switchback rollers 23R shorter. Or, so as to make the conveying distance during the inversion operation of paper-like materials C shorter, that is, so as to bring the stop position of paper-like materials C close to the tapping wheel 22, the control parameter is changed.

On the other hands, when the aforementioned relations of Steps S9 and S10 are not held (Step S9, NO and Step S11, NO), it can be judged that there is little time difference between the time required to pass the switchback device 10 and the time required to pass the detour conveying path 8. In this case, the control parameter of the switchback device 10 is not changed (Step S13).

When the conveying pitch of paper-like materials C passing the joining portion 9 is monitored as mentioned above, even if the passing time of paper-like materials C passing the switchback device 10 and/or the detour conveying path 8 is changed with time, the conveying pitch of paper-like materials C after switching back can be kept constant. By doing this, a higher reliable switchback operation can be realized.

Further, the present invention is not limited to the aforementioned embodiment and can be deformed variously within the scope of the present invention. For example, in the aforementioned embodiment, the classified and recorded conveying pitches are averaged and compared. However, in addition to it, changes of the passing time with time may be obtained using a statistical means such as the normal distribution.

Further, in the aforementioned embodiment, the passing time of paper-like materials C passing the switchback device 10 and the passing time of paper-like materials C passing the detour conveying path 8 are compared and the control parameter of the switchback device 10 is changed. However, when the switchback device 10 has two switchback portions 20R and 20L like this embodiment, the control parameter may be changed by comparing the passing times required for the paper-like materials C to pass the switchback portions 20R and 20L.

As explained above, the switchback device of the present invention has such a constitution and an operation as mentioned above, so that paper-like materials can be turned upside down stably and surely and the conveying pitch between paper-like materials after turning upside down can be kept constant.

What is claimed is:

1. A switchback device comprising:

a conveying path to continuously convey a plurality of paper-like materials;

a switchback portion to receive the paper-like material conveyed on the conveying path in a nip, clamp the paper-like material, decelerate and stop the paper-like material in the clamping state, then accelerate in an opposite direction, send onto the conveying path, thereby invert a conveying direction of the paper-like material; and a controller to keep the paper-like material stopped in the switchback portion for a time decided depending on a length of the paper-like material to be conveyed to the switchback portion in the conveying direction and control an inversion operation for the paper-like material by the switchback portion so as to send out all paper-like materials from the switchback portion at a same conveying pitch as that before inversion.

2. The switchback device according to claim 1, further comprising:

a timing sensor to detect the paper-like material received in the nip immediately before the nip;

wherein the controller starts the inversion operation for the paper-like material by the switchback portion by taking detection of passing of a back end of the paper-like material in the conveying direction via the timing sensor as a trigger.

3. The switchback device according to claim 2, wherein a stopping time of the paper-like material in the switchback portion is decided so that a time required for detecting passing of an end of the paper-like material in the conveying direction by the timing sensor and sending the paper-like material from the switchback portion is made equal for all paper-like materials.

4. A switchback device comprising:

a conveying path to continuously convey a plurality of paper-like materials;

a switchback portion to receive a paper-like material conveyed on the conveying path in a nip, clamp the paper-like material, decelerate and stop the paper-like material in the clamping state, then accelerate in an opposite direction, send onto the conveying path, thereby invert a conveying direction of the paper-like material;

an upstream pitch sensor to detect a conveying pitch between continuous two paper-like materials conveyed to the switchback portion on the conveying path; and a controller to control, when the conveying pitch detected by the upstream pitch sensor is a short pitch which is shorter than a preset reference pitch, so as to shorten a processing time for a preceding paper-like material among the continuous two paper-like materials by the switchback portion, an inversion operation for the preceding paper-like material by the switchback portion.

5. The switchback device according to claim 4, wherein the controller, when the upstream pitch sensor detects the short pitch, controls so as to shorten an acceleration time, a deceleration time, and/or a stopping time for the preceding paper-like material by the switchback portion.

6. The switchback device according to claim 4, wherein the controller, when the upstream pitch sensor detects the short pitch, changes a stop position of the preceding paper-like material so as to shorten a conveying distance of the preceding paper-like material in the switchback portion.

7. A switchback device comprising:

a conveying path to continuously conveying a plurality of paper-like materials;

a switchback portion to receive a paper-like material conveyed on the conveying path in a nip, clamp the paper-like material, decelerate and stop the paper-like material in the clamping state, then accelerate in an opposite direction, send onto the conveying path, thereby invert a conveying direction of the paper-like material;

a detour conveying path to detour the switchback portion;

a downstream pitch sensor to detect a conveying pitch between continuous two paper-like materials conveyed on the conveying path after passing the switchback portion or the detour conveying path; and a controller to control the inversion operation by the switchback portion on the basis of detection results by the downstream pitch sensor so that a time required for the paper-like material to pass the switchback portion and a time required for the paper-like material to pass the detour conveying path are made equal.

8. The switchback device according to claim 7, wherein the controller, on the basis of detection results by the downstream pitch sensor, controls so as to shorten or extend an acceleration time, a deceleration time, and/or a stopping time for the paper-like materials in the switchback portion.

9. The switchback device according to claim 7, wherein the controller, on the basis of detection results by the downstream pitch sensor, changes a stop position of the paper-like materials so as to shorten or extend a conveying distance of the paper-like materials in the switchback portion.

10. A switchback device comprising:

a conveying path to continuously convey a plurality of paper-like materials;

first and second switchback portions to receive a paper-like material conveyed on the conveying path in a nip, clamp the paper-like material, decelerate and stop the paper-like material in the clamping state, then accelerate in an opposite direction, send onto the conveying path, thereby invert a conveying direction of the paper-like material;

a downstream pitch sensor to detect a convey pitch between continuous two paper-like materials conveyed on the conveying path after passing the first and second switchback portions; and a controller to shorten or extend a processing time for the paper-like material by at least one of the first and second switchback portions and control the inversion operation by the first and/or second switchback portion on the basis of detection results by the downstream pitch sensor so that a time required for the paper-like material to pass the first switchback portion and a time required for the paper-like material to pass the second switchback portion are made equal.

11. A switchback method comprising:

continuously conveying a plurality of paper-like materials along a conveying path;

receiving the paper-like material conveyed on the conveying path in a nip;

clamping the paper-like material in the nip;

decelerating and stopping the paper-like material in the clamping state;

accelerating the paper-like material in an opposite direction;

sending the paper-like material onto the conveying path, thereby invert a conveying direction of the paper-like material;

keeping the paper-like material stopped for a time decided depending on a length of the paper-like material to be conveyed in the conveying direction; and controlling an inversion operation for the paper-like material so as to send out all paper-like materials at a same conveying pitch as that before inversion.

* * * * *